US007223073B2

(12) United States Patent
Dean

(10) Patent No.: US 7,223,073 B2
(45) Date of Patent: May 29, 2007

(54) BOAT PROPELLER

(76) Inventor: Peter Dean, P.O. Box 662, Monroe, GA (US) 30655

( * ) Notice: Subject to any disclaimer, the term of this patent is extended or adjusted under 35 U.S.C. 154(b) by 128 days.

(21) Appl. No.: 11/132,527

(22) Filed: May 19, 2005

(65) Prior Publication Data

US 2006/0263219 A1 Nov. 23, 2006

(51) Int. Cl.
*B63H 1/20* (2006.01)

(52) U.S. Cl. ..... 416/134 R

(58) Field of Classification Search ..... 416/93 A, 416/134 R

See application file for complete search history.

(56) References Cited

U.S. PATENT DOCUMENTS

| | | | | |
|---|---|---|---|---|
| 3,045,763 | A * | 7/1962 | Perrott | 464/32 |
| 3,947,151 | A | 3/1976 | Stillerud et al. | 416/93 |
| 4,045,122 | A | 8/1977 | Burdick | 350/97 |
| 4,097,191 | A | 6/1978 | Genuardi | 416/170 |
| 4,202,655 | A | 5/1980 | Maloof | 416/237 |
| 4,212,586 | A | 7/1980 | Aguiar | 416/93 |
| 4,310,285 | A | 1/1982 | Blanchard | 416/134 |
| 4,388,070 | A | 6/1983 | Kasschau | 440/89 |
| 4,428,716 | A | 1/1984 | Maloof | 416/157 |
| 4,511,339 | A | 4/1985 | Kasschau | 440/89 |
| 4,826,404 | A * | 5/1989 | Zwicky | 416/134 R |
| 4,898,552 | A | 2/1990 | Cochran | 440/71 |
| D307,738 | S | 5/1990 | Kerr | D12/214 |
| 4,930,987 | A | 6/1990 | Stahl | 416/93 |
| D310,812 | S | 9/1990 | Bergeron | D12/214 |
| D316,700 | S | 5/1991 | Morrison | D12/214 |
| 5,049,034 | A * | 9/1991 | Cahoon | 416/134 R |
| 5,102,301 | A | 4/1992 | Morrison | 416/163 |
| 5,104,291 | A | 4/1992 | Morrison | 416/168 |
| 5,158,433 | A | 10/1992 | Cleary | 416/93 |
| 5,201,679 | A | 4/1993 | Velte, Jr. et al. | 440/49 |
| 5,252,028 | A | 10/1993 | LoBosco et al. | 416/93 |
| 5,462,411 | A | 10/1995 | Bianchi | 416/202 |
| 5,529,158 | A | 6/1996 | Itoh et al. | 192/35 |
| 5,549,455 | A | 8/1996 | Speer | 416/93 |
| 5,642,986 | A | 7/1997 | Rose | 416/240 |
| 5,857,880 | A | 1/1999 | Harada | 440/89 |
| 6,010,380 | A | 1/2000 | Wollard | 440/89 |
| D424,504 | S | 5/2000 | Neisen | D12/214 |
| D425,009 | S | 5/2000 | Neisen | D12/214 |
| D435,238 | S | 12/2000 | Neisen | D12/214 |
| 6,158,960 | A | 12/2000 | Marsi | 416/43 |
| 6,176,680 | B1 | 1/2001 | Ringblom et al. | 416/212 |
| 6,241,473 | B1 | 6/2001 | Soule et al. | 416/42 |

(Continued)

OTHER PUBLICATIONS

Michigan Wheel Corporation, web page down loaded from the website, (2005).
Mercury Marine, web page down loaded from the website, (2005).
Lin "Solas-Where Speed Begins," (2006).

*Primary Examiner*—Ninh H. Nguyen
(74) *Attorney, Agent, or Firm*—Needle & Rosenberg, P.C.

(57) ABSTRACT

A boat propeller comprising a central hub member and an inner hub assembly that defines a longitudinally extending bore having an inner surface. The exterior surface of the central hub member is sized and shaped for disposition therein the bore of the inner hub assembly in a complementary fashion. In one aspect, the propeller may also comprise a plurality of resilient spacer members positioned such that that the exterior surface of the central hub member is spaced from the inner surface of the bore.

25 Claims, 6 Drawing Sheets

U.S. PATENT DOCUMENTS

| | | | | |
|---|---|---|---|---|
| 6,280,142 | B1 | 8/2001 | Pruden et al. | 416/146 |
| 6,383,042 | B1 | 5/2002 | Neisen | 440/49 |
| 6,471,481 | B2 | 10/2002 | Chen | 416/134 |
| 6,609,892 | B1 | 8/2003 | Kreul et al. | 416/134 |
| 6,659,818 | B2 * | 12/2003 | Booe | 440/83 |
| 6,685,432 | B2 | 2/2004 | Chen | 416/134 |
| 7,056,091 | B2 | 6/2006 | Powers | 416/93 |
| 2002/0085914 | A1 | 7/2002 | Chen | 416/134 |
| 2003/0012652 | A1 | 1/2003 | Chen | 416/134 |
| 2005/0191180 | A1 | 9/2005 | Powers | 416/93 |
| 2006/0093486 | A1 | 5/2006 | Gaiani | 416/204 |

* cited by examiner

BOAT PROPELLER

FIELD OF THE INVENTION

The present invention relates to a propeller for a boat, more specifically to a propeller for a higher horsepower motor.

BACKGROUND OF THE INVENTION

The bushing system design for marine propellers has remained relatively unchanged since the early 1940's. Typically, a bushing is used to make a connection between the propeller body and the drive hub on the propeller shaft. The conventional bushing generally is formed from a hard rubber and makes the connection using friction. The rubber bushing is bonded to a center hub made of metal or plastic and the rubber is designed to be larger than the hole in which it is to be inserted. An installation funnel is used to compress the diameter of the rubber bushing to enable it to be inserted into the propeller bore. One of the benefits of this conventional design is that it gives both impact protection and harmonic vibration absorption protection. Another benefit of this conventional design is that, under impact, the rubber bushing will slip and, in most cases, reconnect or lock up again and enable the boat to continue to drive, at least under limited power.

When the maximum horsepower of boats with outboard motors was 25 hp, this conventional bushing design was ample. However, current horsepower ratings of boats far exceed the design capabilities of such a conventional bushing. With so much torque under impact, the rubber bushing slips and melts. As a result, the bushing does not return to its normal size and becomes unusable in seconds. The damaged conventional bushing remains loose within the propeller bore, leaving the boat drive system useless and the boat undriveable.

To correct this problem with higher horsepower motors, manufacturers have placed a hard plastic or metal keyed piece to operatively engage the hub of the propeller. While this method reduces failures akin to the ones mentioned above with the conventional rubber bushings, it does not provide any protection for the drive train under impact, it does not absorb any harmonic vibration from the motor or drive train, and it does not remain sufficiently tight on the propeller shaft. The latter issue induces a rattle in the propeller shaft and produces operating noise. It also promotes wear and tear on all the drive components.

There are other designs that have the same and other pitfalls as mentioned herein above. Therefore, what is needed is a propeller bushing that provides the protection of a rubber bushing, while providing the positive lock of a keyed system for higher horsepower motors.

SUMMARY

The present invention relates to a boat propeller having a longitudinal axis. The propeller comprises an inner hub assembly defining a longitudinally extending bore. The bore extends substantially rearward, concentrically about the longitudinal axis.

The propeller also comprises a central hub member. The exterior surface of the central hub member is sized and shaped for disposition within the bore of the inner hub assembly. In one aspect, the exterior surface of the central hub member and the surface of the bore are complementarily keyed. In one aspect, the bore of the inner hub assembly and the exterior surface of the central hub member may be substantially cylindrically shaped, or they may be slightly tapered in a complimentary fashion such that the diameter of the bore gets smaller as the bore extends longitudinally inwardly from its first end to its second end.

The central hub may also define a longitudinally extending conduit that extends substantially rearward, concentrically about the longitudinal axis. In this instance, the conduit of the central hub is adapted to mount thereon a rotatable drive shaft such that rotation of the drive shaft about the longitudinal axis imparts rotation of the propeller about its longitudinal axis.

The inner hub assembly of the propeller is spaced therefrom the central hub member by a plurality of resilient spacer members. The resilient spacer members are designed to absorb impact forces from the propeller, as well as harmonic vibration from the motor. The cushion provided by the resilient spacer members protects the drive shaft from damage due to the aforementioned impact forces and harmonic vibration.

BRIEF DESCRIPTION OF THE DRAWINGS

These and other features of the preferred embodiments of the present invention will become more apparent in the detailed description in which reference is made to the appended drawings wherein.

DETAILED DESCRIPTION OF THE INVENTION

Figure 1:
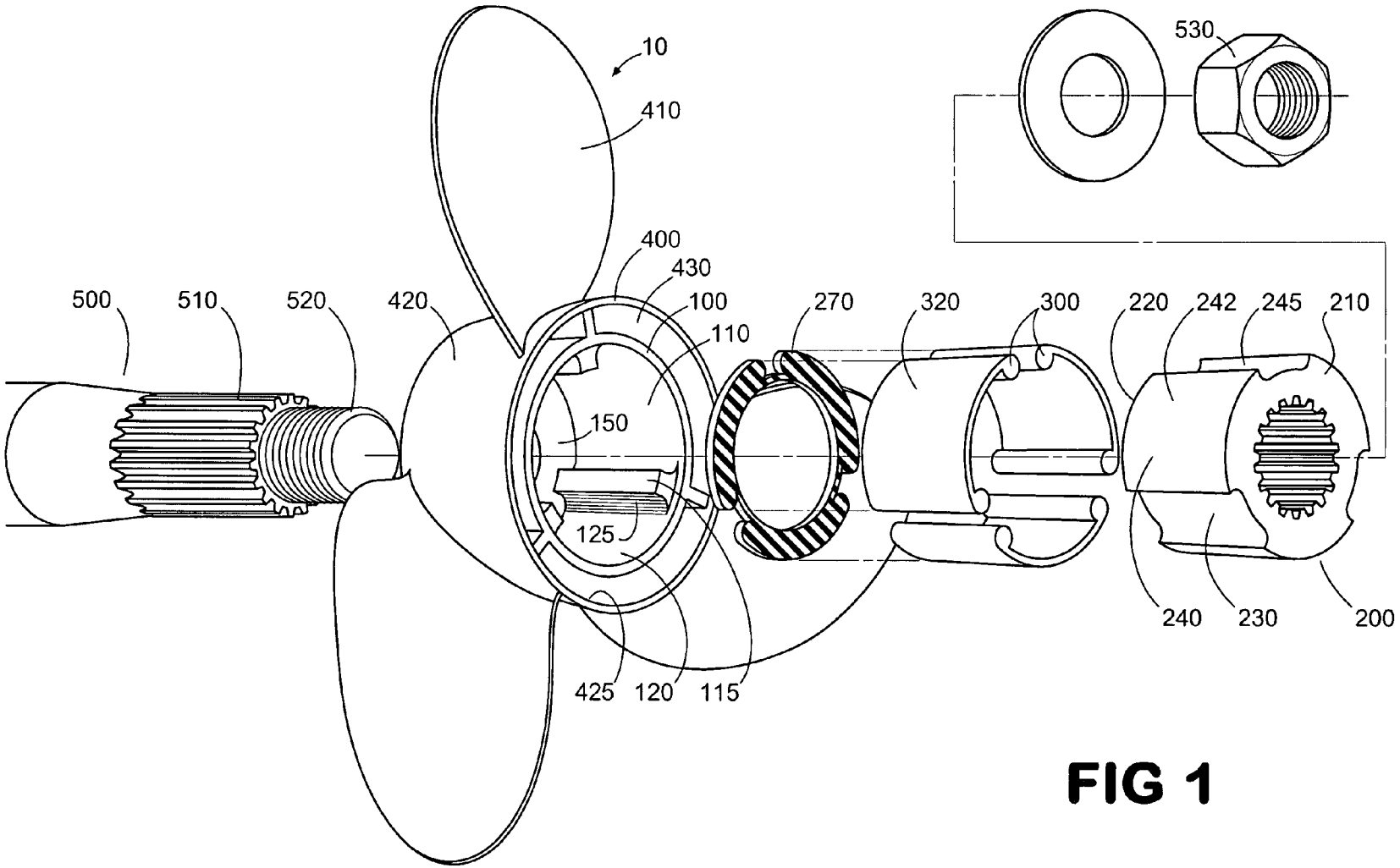
FIG. 1 is an exploded perspective view of one aspect of the present invention for a propeller showing an outer hub assembly, an inner hub assembly, a plurality of resilient spacer members, a plurality of resilient bands, a central hub member, and a rotatable drive shaft.
Figure 2:
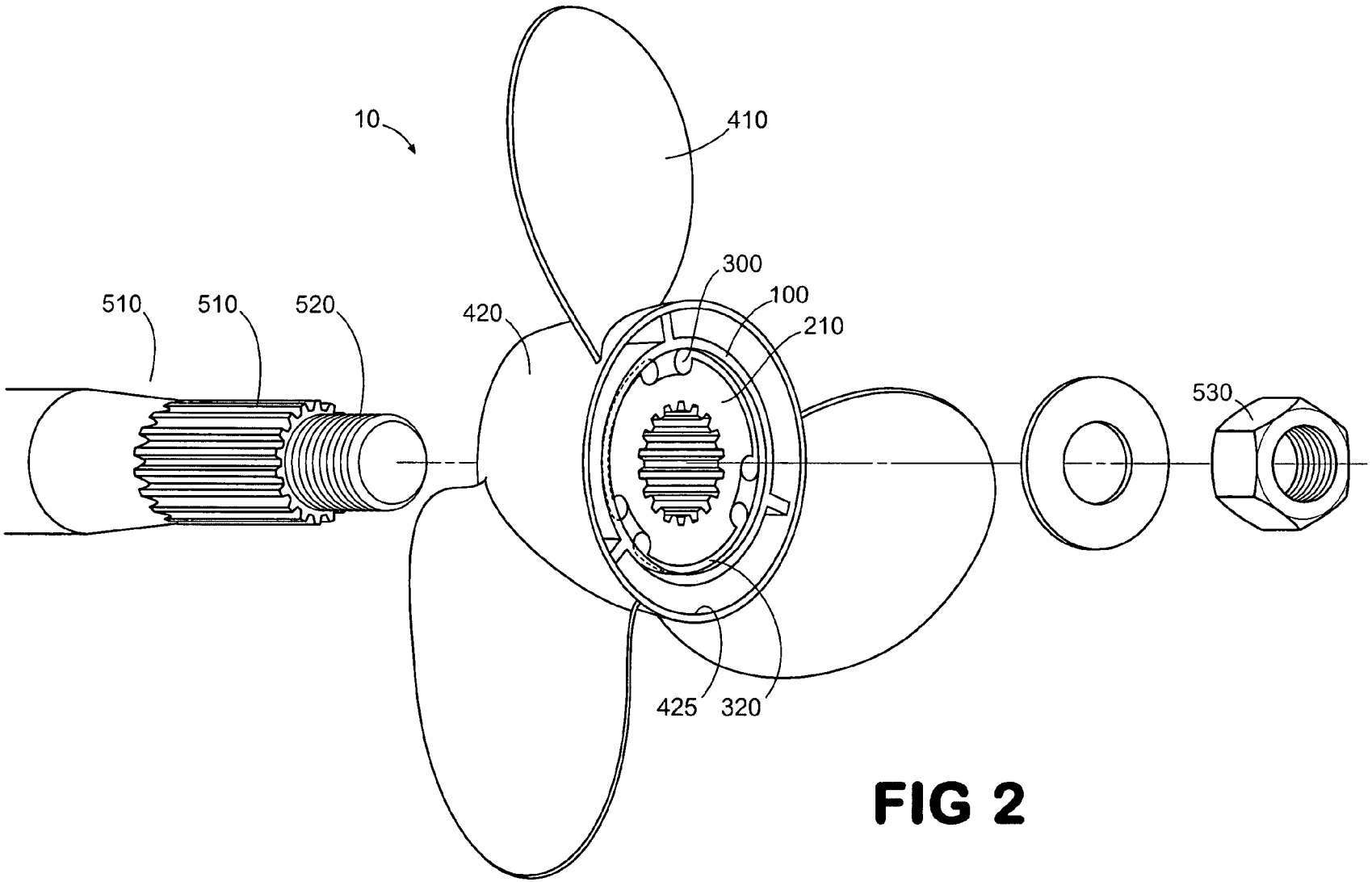
FIG. 2 is a perspective view of the propeller of FIG. 1.
Figure 4:
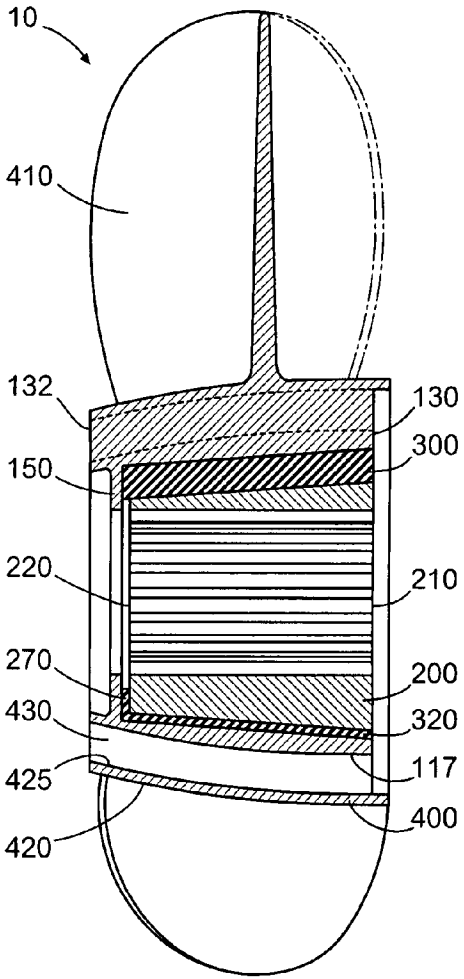
FIG. 4 is a side cross-sectional view of the propeller of FIG. 1, taken along line 4—4 of FIG. 3.

The present invention is more particularly described in the following exemplary embodiments that are intended as illustrative only since numerous modifications and variations therein will be apparent to those skilled in the art. As used herein, "a," "an," or "the" can mean one or more, depending upon the context in which it is used. The preferred embodiments are now described with reference to the figures, in which like reference characters indicate like parts throughout the several views.

Ranges may be expressed herein as from "about" one particular value, and/or to "about" another particular value.

When such a range is expressed, another embodiment includes from the one particular value and/or to the other particular value. Similarly, when values are expressed as approximations, by use of the antecedent "about," it will be understood that the particular value forms another embodiment.

In one aspect of the present invention for a boat propeller 10 having a longitudinal axis, the propeller 10 comprises an inner hub assembly 100 defining a longitudinally extending bore 110. The bore 110 of the inner hub assembly 100 extends substantially rearward, concentrically about the longitudinal axis. In one aspect, an inner surface 115 of the bore defines at least one longitudinally extending slot 120 having opposed edge surfaces 115. Exemplarily, the edge surfaces 115 may be curved or substantially straight. In either case, each slot 120 extends outwardly away from the longitudinal axis of the propeller.

The propeller 10 also comprises a central hub member 200. The central hub member 200 has a proximal end 210, an opposed distal end 220, and an exterior surface 230. The exterior surface 230 of the central hub member is sized and shaped for disposition therein the bore 110 of the inner hub assembly 100. As such, in one aspect, the exterior surface defines at least one longitudinally extending male rib 240 having opposed side surfaces 230. It is contemplated that the bore 110 of the inner hub assembly and the exterior surface 230 of the central hub member are substantially cylindrically shaped. In another aspect, it is contemplated that the bore of the inner hub assembly and the exterior surface 230 of the central hub member are tapered in a complimentary fashion such that the diameter of the bore gets smaller as the bore extends longitudinally inwardly from the first end 130 of the bore to the second end 132 of the bore. The central hub member 200 is formed from a substantially rigid material suitable for matching the horsepower of the motor used, such as, for example and not meant to be limiting, brass, aluminum, stainless steel, plastic, polypropylene, and the like.

In one aspect, in order to compliment the shape of the male rib 240 of the exterior surface 230 of the central hub member 200, the slot 120 of the inner hub assembly 100 is sized to substantially surround at least a portion of the male rib. Resultantly, a cavity 250 is defined by a portion of each edge surface of the slot of the inner hub assembly that faces and is spaced from a portion of a respective side surface of the rib of the central hub member. In one aspect, the slots 120 may be larger than the ribs 240 and a cavity 250 may be formed on either side of each rib.

Figure 6:
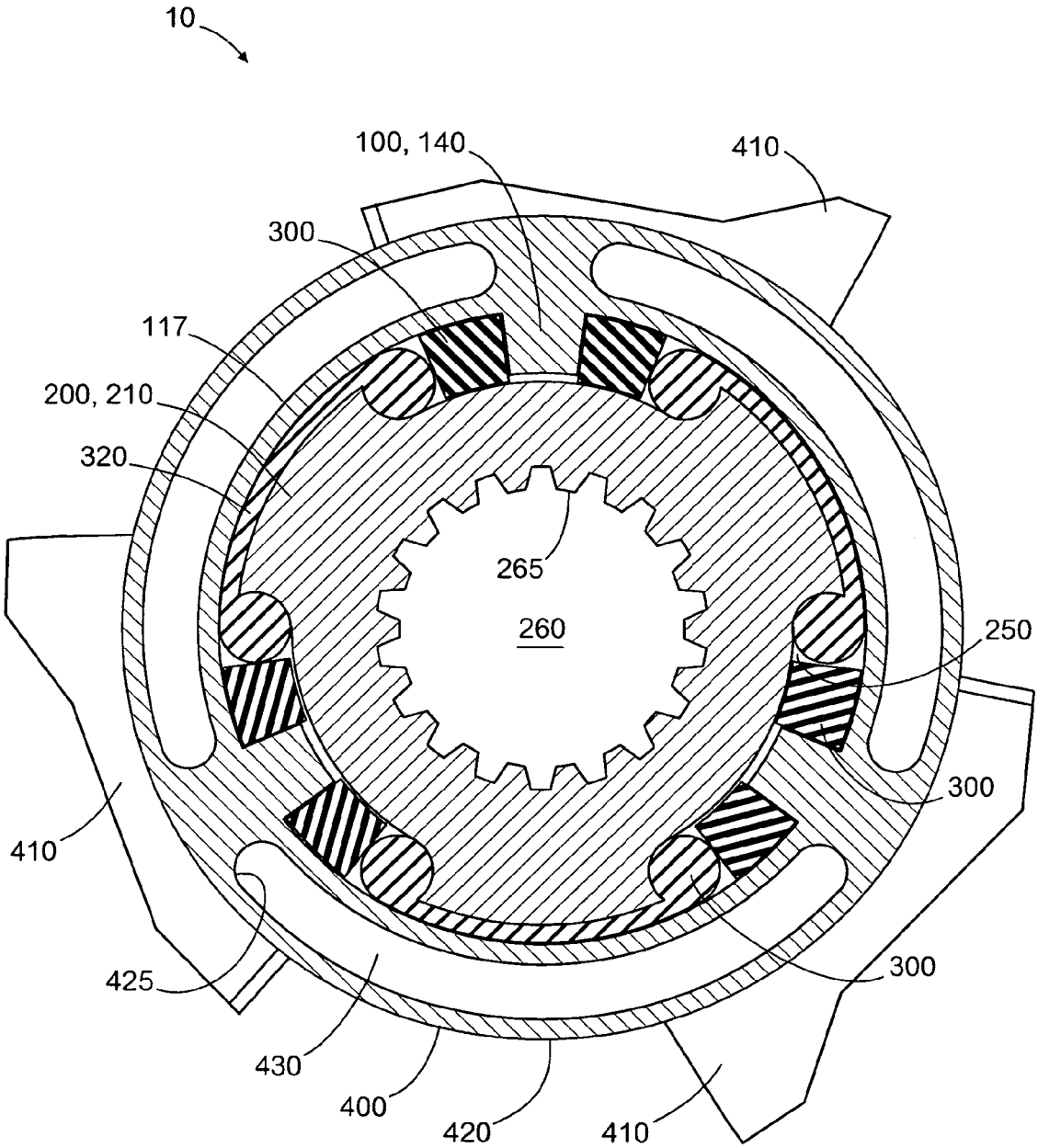
FIG. 6 is a partial front cross-sectional view of one aspect of the present invention for a propeller showing additional resilient spacer members.

In another aspect, the propeller 10 further comprises a plurality of resilient spacer members 300 that are constructed and arranged such that at least a portion of one resilient spacer member is adapted to mount therein at least a portion of one formed cavity. In this aspect, the exterior surface of the central hub member 200 is spaced from the inner surface 115 of the bore of the inner hub assembly. When mounted therebetween portions of the central hub member and the inner hub assembly, the resilient spacer members 300 provide a cushion that separates the central hub member 200 and the inner hub assembly 100. In yet another aspect, as depicted in FIG. 6, the cavity 250 may be filled with multiple resilient spacer members 300.

In one aspect, the propeller further comprises an outer hub assembly 400 connected to an outer surface of the inner hub assembly. Here, the exterior surface 420 of the outer hub assembly 400 has a plurality of propeller blades 410 attached to and extending outwardly away from the outer surface. In use, the exterior surface 420 of the outer hub assembly 400 is in contact with the water.

Figure 3:
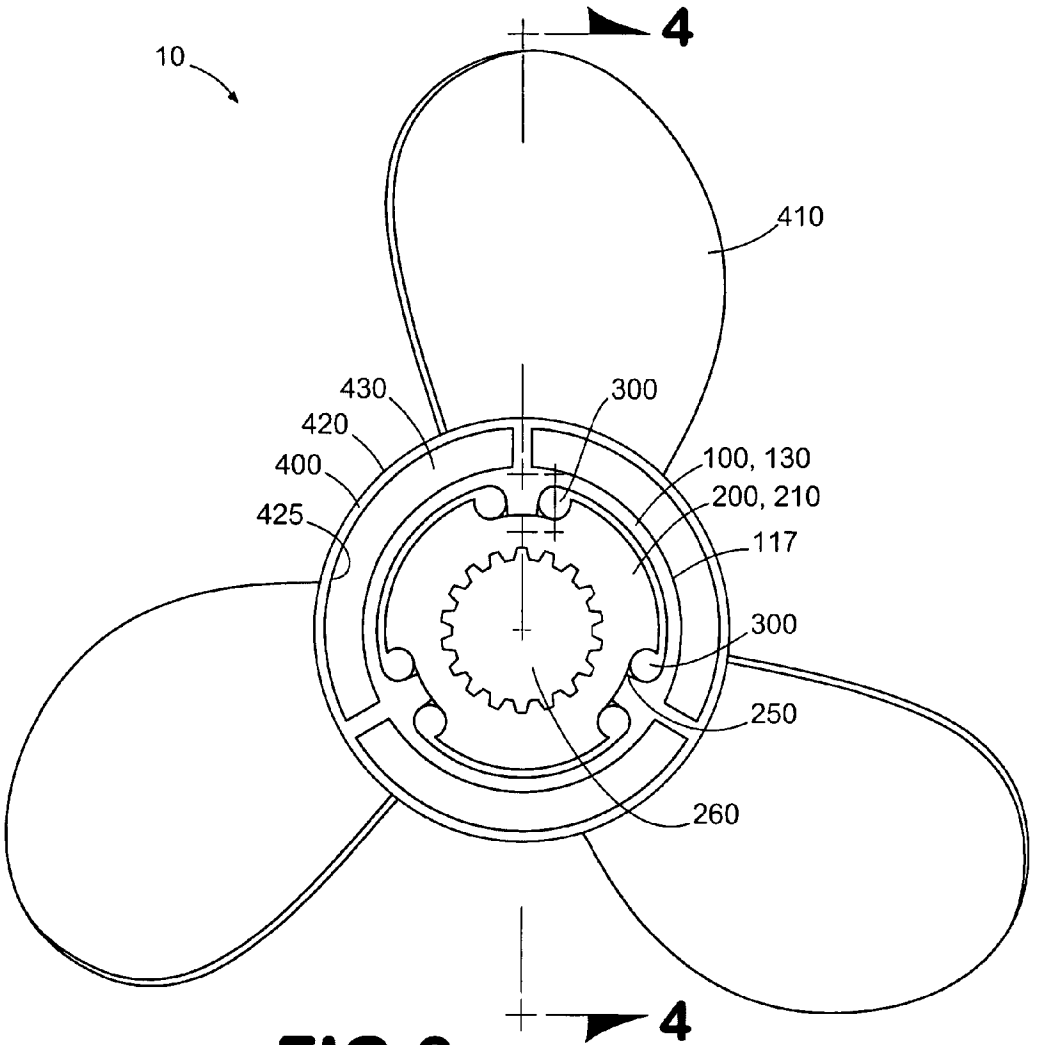
FIG. 3 is a front cross-sectional view of the propeller of FIG. 1, taken along line 3—3 of FIG. 2.

In yet another aspect, the outer hub assembly has an interior surface 420 and at least one passageway 430 is defined therebetween the interior surface 420 of the outer hub assembly 400 and the outer surface 117 of the inner hub assembly 100. This passageway 430 permits the release of exhaust gases from the engine of the watercraft. As can be seen in FIG. 3, this aspect of the invention allows for a larger exhaust passageway 430 than is required, which can improve engine performance and allow the fuel-air mixture to burn cleaner on larger motors by lowering the exhaust back-pressure. This design, due to the cleaner fuel burning, also reduces emissions.

In one aspect, the central hub member 200 defines a longitudinally extending conduit that extends substantially rearward, concentrically about the longitudinal axis. The drive shaft 500 is sized and shaped for engagement with the conduit of the central hub member, such that rotation of the drive shaft 500 about the longitudinal axis imparts rotation of the propeller about the longitudinal axis. Exemplarily and not meant to be limiting, the exterior surface 510 of the drive shaft 500 comprises a plurality of splines that are sized and shaped for complimentary engagement with the inner surface of the conduit of the central hub member. Of course, it is contemplated that the respective surfaces can be complimentarily shaped for engagement in any conventional fashion.

In another aspect, the interior surface 420 of the outer hub comprises plurality of slots 120, and the exterior surface 230 of the central hub member 200 comprises a plurality of male ribs 240. It is contemplated that the respective pluralities of slots and ribs may be spaced substantially equally apart relative to the longitudinal axis of the propeller, or they may be unevenly spaced. Further, in one aspect, the respective pluralities of slots and ribs may extend substantially the entire longitudinal length of the inner hub assembly 100, or they may only extend a portion therein. The surface area therebetween the adjacent slots and ribs is sized to withstand the torque exerted by the drive shaft.

Figure 5:
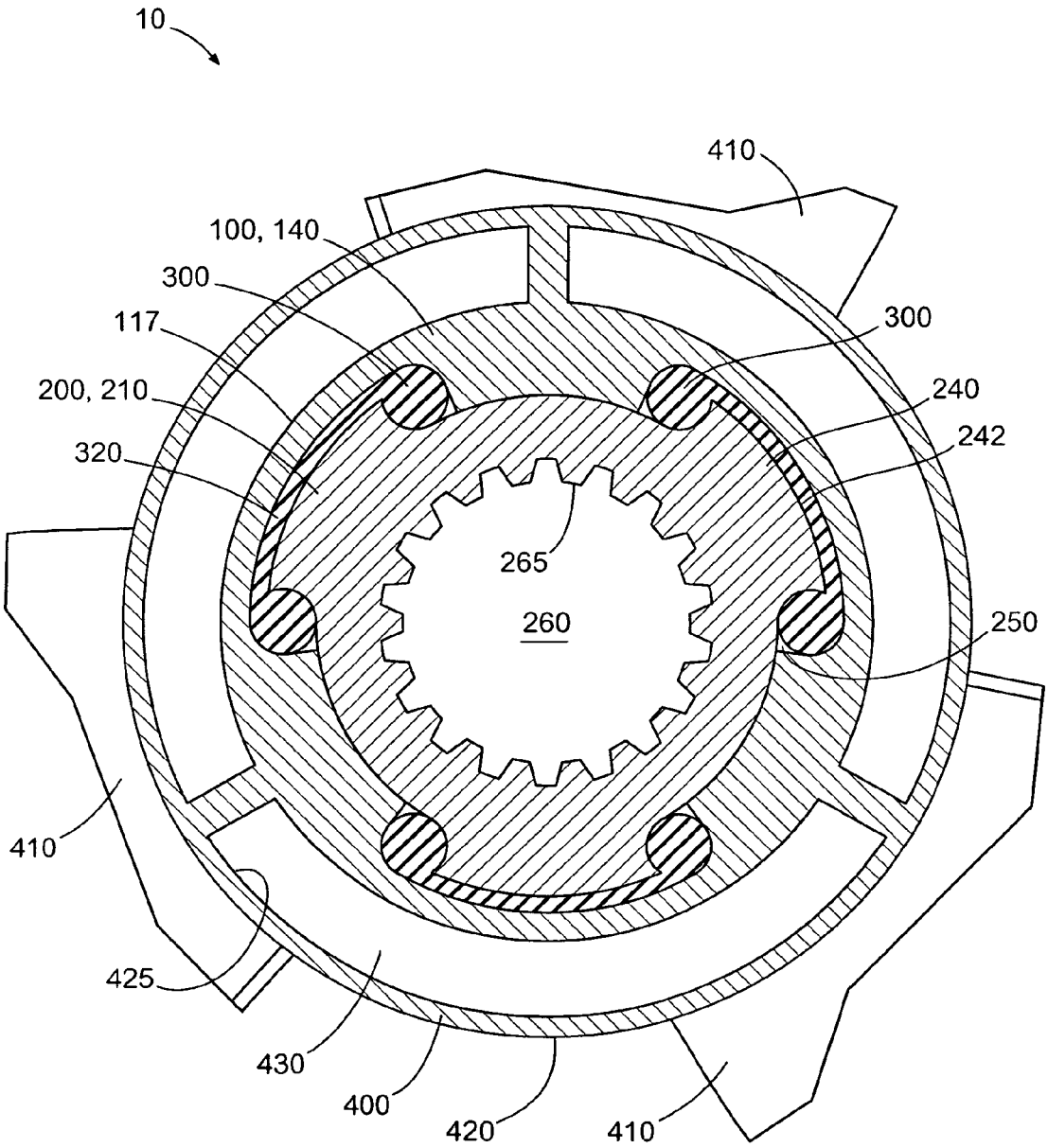
FIG. 5 is a partial front cross-section view of the propeller of FIG. 1.

In still another aspect, the edge surfaces 115 of each slot 120 have a curved cross-sectional shape and the side surfaces 230 of each rib 240 have a curved cross-sectional shape. By making the edge surface and the side surface curved in their cross-section, the cavity that is formed therebetween, as is seen in FIG. 5, has a substantially circular cross section. In this aspect, at least a portion of each resilient spacer member 300 has a circular cross-sectional shape in order to compliment the shape of the cavity 250.

In one aspect, each resilient spacer member has a diameter that is greater than the height of each rib and the depth of each slot. Thus, the resilient spacer member spaces the inner surface 115 of the bore of the inner hub assembly from the exterior surface of the central hub member. As can be appreciated and as shown in the figures, the resilient spacer member can have practically any cross-sectional shape. For instance, the cross-sectional shape of the resilient spacer member may square, rectangular, round, elliptical, etc.

Figure 7:
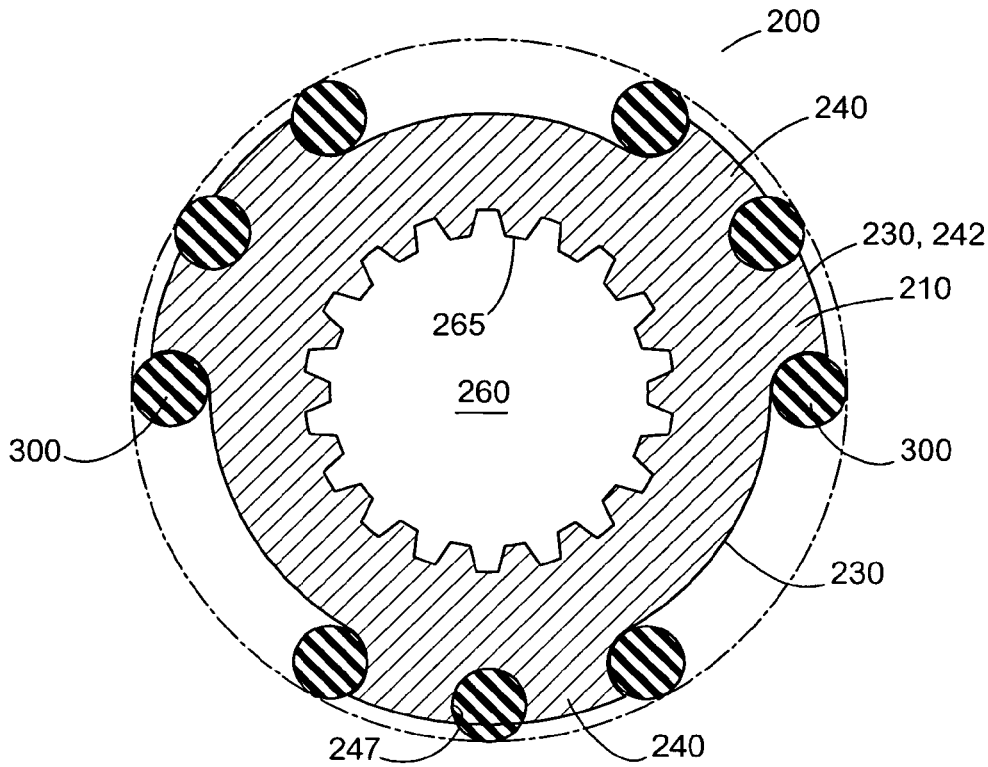
FIG. 7 is a partial front cross-sectional view of one aspect of the present invention for a propeller showing the top surface of each rib of the central hub defining a longitudinally extending groove that is adapted for mounting a bottom portion of one resilient spacer member therein.
Figure 8:
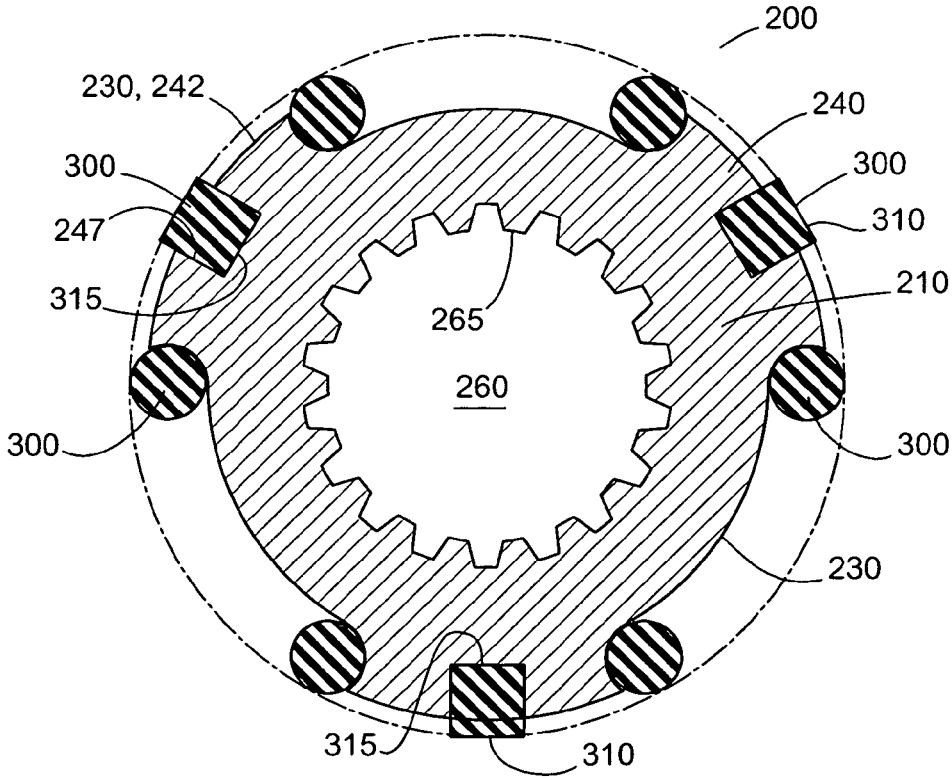
FIG. 8 is a partial front cross-sectional view of one aspect of the present invention for a propeller showing the top surface of each rib of the central hub defining a longitudinally extending groove that is adapted for mounting a bottom portion of one resilient spacer member therein.

In one aspect, the top surface 242 of each rib 240 defines a longitudinally extending groove 247 that is adapted for mounting a bottom portion 315 of one resilient spacer member 300 therein such that a top portion 310 of the resilient spacer member extends upwardly away from the top surface 242. In this aspect, as shown in FIGS. 7 and 8, the resilient spacer member 300 disposed therein the groove 247 extends above the top surface of the rib substantially the same distance as the resilient spacer member disposed within the cavity 250 formed by the edge surface of the slot and the side surface of the rib. This way, the resilient spacer members 300, together, space the entire inner surface 115 of the bore of the inner hub assembly from the exterior surface of the central hub member and provide a cushion for protecting the drive shaft in the event of a propeller impact, as well as protecting against harmonic vibration.

Alternatively, to achieve the cushion between the inner surface of the bore of the inner hub assembly and the exterior surface 230 of the central hub member 200, at least one resilient band 320 is provided. Each resilient band 320 overlies a portion of the top surface 242 of each rib 240 and contacts adjacent resilient spacer members 300 disposed in the cavities 250, as shown in FIG. 1. In this aspect, the resilient band is positioned therebetween the inner surface 115 of the bore of the inner hub assembly and the top surface of the rib of the central hub member.

In another aspect, the inner hub assembly 100 has a back end, which is adjacent the drive shaft 500. The back end 145 of the inner hub assembly forms a concentric shoulder 150, which is adapted to stop the central hub member from being inserted past the back end of the propeller 10 assembly. In use, the central hub member of the propeller is placed on the drive shaft until the threaded end 520 of the drive shaft 500 protrudes from the conduit of the central hub member. Then, a propeller nut 530 is tightened onto the threaded end 520 such that the distal end 220 of the central hub member is compressed against the concentric shoulder 150, securing the propeller assembly onto the drive shaft 500.

In yet another aspect, a resilient washer member 270 is positioned therebetween the concentric shoulder 150 and the distal end of the central hub member. It provides protection for the end of the central hub member and further cushions against harmonic vibration and propeller impact. This design ensures that there is no direct contact between the exterior surface 230 of the central hub member and the inner surface 115 of the bore of the inner hub assembly.

The resilient spacer members and the resilient band can be made from any substantially elastic material known by those skilled in the art. For example and not meant to be limiting, they may be constructed from rubber, polypropylene, nylon, polyurethane, plastic, and the like. The hardness of the material can be determined based upon the horsepower of the motor used. For higher horsepower motors, it is recommended to use a harder material.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A boat propeller having a longitudinal axis, comprising:

an inner hub assembly defining a longitudinally extending bore having an inner surface, wherein the bore extends substantially rearward concentrically about the longitudinal axis, wherein the bore has a first end having a first diameter and an opposed second end having a second diameter, the first diameter being greater than the second diameter, wherein the bore tapers from the first end towards the second end, and wherein the inner surface of the bore comprises at least one longitudinally extending slot having opposed edge surfaces, the slot extending outwardly away from the longitudinal axis; and a central hub member having a proximal end, an opposed distal end, and an exterior surface, the exterior surface of the central hub member defining at least one longitudinally extending male rib having opposed side surfaces, wherein the exterior surface of the central hub member is sized and shaped for disposition therein the bore of the inner hub assembly such that a plurality of longitudinally extending cavities are defined, each cavity being defined by a portion of each edge surface of the slot of the inner hub assembly that faces and is spaced from a portion of a respective side surface of the rib of the central hub member; and a plurality of resilient spacer members, wherein at least a portion of one resilient spacer member is adapted to mount therein at least a portion of one cavity such that the exterior surface of the central hub member is spaced from the inner surface of the bore.

2. The boat propeller of claim 1, wherein the at least one slot comprises a plurality of slots, and wherein the at least one male rib comprises a plurality of male ribs.

3. The boat propeller of claim 2, wherein the plurality of slots are angularly spaced substantially equally apart relative to the longitudinal axis, and wherein the male ribs are angularly spaced substantially equally apart.

4. The boat propeller of claim 3, wherein the plurality of slots comprises three slots, and wherein the plurality of male ribs comprises three male ribs.

5. The boat propeller of claim 1, wherein the at least one slot extends the substantial longitudinal length of the inner hub assembly.

6. The boat propeller of claim 1, wherein the at least one rib extends the substantial longitudinal length of the central hub member.

7. The boat propeller of claim 1, further comprising an outer hub assembly connected to an outer surface of the inner hub assembly, wherein an exterior surface of the outer hub assembly has a plurality of propeller blades attached to and extending outwardly away from the exterior surface.

8. The boat propeller of claim 7, wherein the outer hub assembly has an interior surface, and wherein a passageway is defined therebetween the interior surface of the outer hub assembly and the outer surface of the inner hub assembly.

9. The boat propeller of claim 1, wherein the bore of the inner hub assembly is cylindrically shaped.

10. The boat propeller of claim 1, wherein the edge surfaces of each slot has a curved cross-sectional shape.

11. The boat propeller of claim 1, wherein the side surface of each rib has a curved cross-sectional shape.

12. The boat propeller of claim 11, wherein each resilient spacer member has a diameter that is greater than the height of each rib and the depth of each slot.

13. The boat propeller of claim 1, wherein at least a portion of each resilient spacer member has a circular cross-sectional shape.

14. The boat propeller of claim 1, wherein the inner hub assembly has a back end, and wherein the back end of the inner hub assembly forms a concentric shoulder.

15. The boat propeller of claim 14, further comprising a resilient washer member positioned therebetween the concentric shoulder and the distal end of the central hub member.

16. The boat propeller of claim 1, wherein the central hub member defines a longitudinally extending conduit, the conduit extending substantially rearward concentrically about the longitudinal axis.

17. The boat propeller of claim 16, further comprising a rotatable drive shaft sized and shaped for engagement with the conduit of the central hub member, such that rotation of the drive shaft about the longitudinal axis imparts rotation of the propeller about the longitudinal axis.

18. A boat propeller having a longitudinal axis, comprising:

an inner hub assembly defining a longitudinally extending bore having an inner surface, wherein the bore extends substantially rearward concentrically about the longitudinal axis, and wherein the inner surface of the bore comprises at least one longitudinally extending slot having opposed edge surfaces, the slot extending outwardly away from the longitudinal axis; and a central hub member having a proximal end, an opposed distal end, and an exterior surface, the exterior surface of the central hub member defining at least one longitudinally extending male rib having a top surface and opposed side surfaces, wherein the exterior surface of the central hub member is sized and shaped for disposition therein the bore of the inner hub assembly such that a plurality of longitudinally extending cavities are defined, each cavity being defined by a portion of each edge surface of the slot of the inner hub assembly that faces and is spaced from a portion of a respective side surface of the rib of the central hub member; and a plurality of resilient spacer members, wherein at least a portion of one resilient spacer member is adapted to mount therein at least a portion of one cavity such that the exterior surface of the central hub member is spaced from the inner surface of the bore, wherein the top surface of each rib defines a longitudinally extending groove that is configured for mounting of a bottom portion of one resilient spacer member therein such that a top portion of the resilient spacer member extends upwardly away from the top surface of the rib.

19. The boat propeller of claim 18, wherein the at least one slot comprises a plurality of slots, and wherein the at least one male rib comprises a plurality of male ribs.

20. The boat propeller of claim 19, wherein the plurality of slots are angularly spaced substantially equally apart relative to the longitudinal axis, and wherein the male ribs are angularly spaced substantially equally apart.

21. The boat propeller of claim 18, further comprising a rotatable drive shaft sized and shaped for engagement with the conduit of the central hub member, such that rotation of the drive shaft about the longitudinal axis imparts rotation of the propeller about the longitudinal axis.

22. A boat propeller having a longitudinal axis, comprising:

an inner hub assembly defining a longitudinally extending bore having an inner surface, wherein the bore extends substantially rearward concentrically about the longitudinal axis, and wherein the inner surface of the bore comprises at least one longitudinally extending slot having opposed edge surfaces, the slot extending outwardly away from the longitudinal axis; and a central hub member having a proximal end, an opposed distal end, and an exterior surface, the exterior surface of the central hub member defining at least one longitudinally extending male rib having a top surface and opposed side surfaces, wherein the exterior surface of the central hub member is sized and shaped for disposition therein the bore of the inner hub assembly such that a plurality of longitudinally extending cavities are defined, each cavity being defined by a portion of each edge surface of the slot of the inner hub assembly that faces and is spaced from a portion of a respective side surface of the rib of the central hub member;

a plurality of resilient spacer members, wherein at least a portion of one resilient spacer member is adapted to mount therein at least a portion of one cavity such that the exterior surface of the central hub member is spaced from the inner surface of the bore; and at least one resilient band overlying a portion of the top surface of each rib and contacting adjacent members, the resilient band being positioned therebetween the interior surface of the inner hub assembly and the top surface of the rib of the central hub member.

23. The boat propeller of claim 22, wherein the at least one slot comprises a plurality of slots, and wherein the at least one male rib comprises a plurality of male ribs.

24. The boat propeller of claim 23, wherein the plurality of slots are angularly spaced substantially equally apart relative to the longitudinal axis, and wherein the male ribs are angularly spaced substantially equally apart.

25. The boat propeller of claim 22, further comprising a rotatable drive shaft sized and shaped for engagement with the conduit of the central hub member, such that rotation of the drive shaft about the longitudinal axis imparts rotation of the propeller about the longitudinal axis.

* * * * *